United States Patent [19]

Lameris

[11] Patent Number: 4,796,570

[45] Date of Patent: Jan. 10, 1989

[54] APPARATUS FOR HEATING STEAM FORMED FROM COOLING WATER

[75] Inventor: Herman J. Lameris, Utrecht, Netherlands

[73] Assignee: Shell Internationale Research Maatschappij B.V., The Hague, Netherlands

[21] Appl. No.: 79,534

[22] Filed: Sep. 30, 1987

[30] Foreign Application Priority Data

Aug. 26, 1986 [NL] Netherlands ..... 8602162

[51] Int. Cl.[4] ..... F22D 1/00

[52] U.S. Cl. ..... 122/7 R; 122/32

[58] Field of Search ..... 122/7 R, 32, 479 A; 165/163

[56] References Cited

U.S. PATENT DOCUMENTS

| | | | |
|---|---|---|---|
| 4,462,339 | 7/1984 | Jahnke et al. | 122/7 R |
| 4,488,513 | 12/1984 | Jahnke et al. | 122/7 R X |
| 4,522,155 | 6/1985 | Vollhardt et al. | 122/7 R |
| 4,694,782 | 9/1987 | Premel et al. | 122/7 R |

*Primary Examiner*—Edward G. Favors

*Attorney, Agent, or Firm*—Jones, Tullar & Cooper

[57] ABSTRACT

Steam is generated from cooling water in a heat exchanger for hot gases. Subsequently the steam is superheated by the gases to be cooled. This process is carried out by providing submerged water-tube superheater modules in, for example, a waste heat boiler/evaporator.

9 Claims, 4 Drawing Sheets

APPARATUS FOR HEATING STEAM FORMED FROM COOLING WATER

Figure 1A:
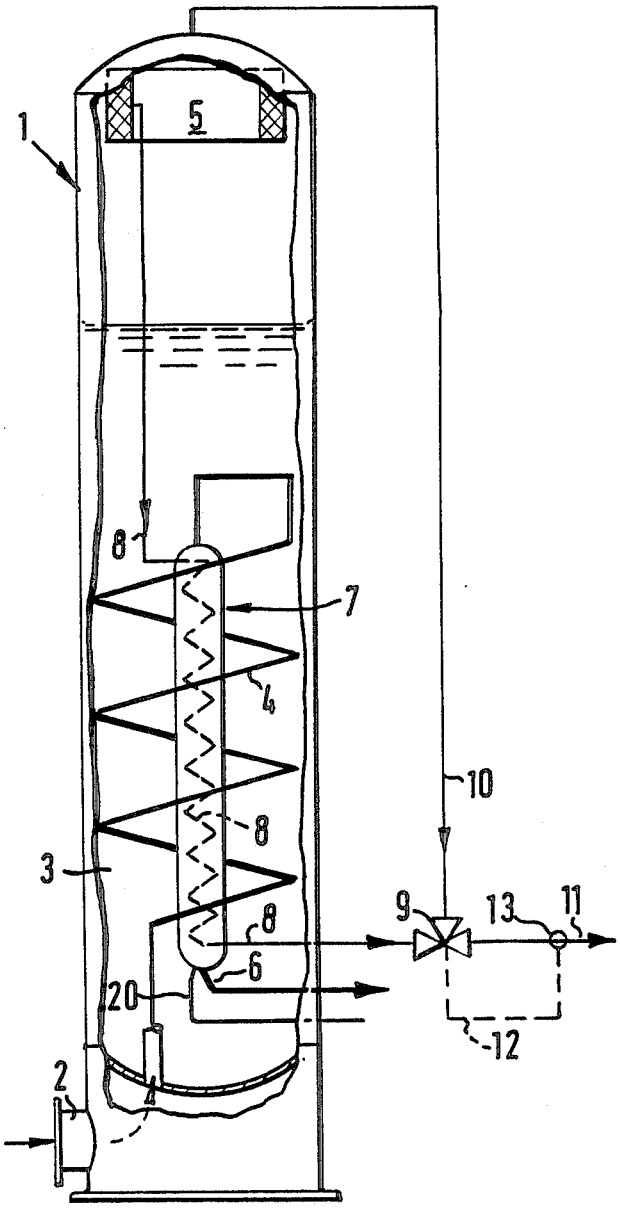

The invention relates to a process and an apparatus for heating steam formed from cooling water in a heat exchanger for hot gas.

For cooling process gas, use is made of a heat exchanger, for example in the form of a spiral tube, through which the gas to be cooled is passed. Usually, the process gas in question has a temperature of above 1300° C. and a gas pressure of more than 30 bar. The heat exchanger is cooled by a coolant, for example water, said coolant usually being above the gas pressure. Due to the high heat load and the relatively long residence time to and of the coolant respectively, steam is formed which is caught in a compartment provided for that purpose. This steam is saturated. For subsequent processing, the steam should be brought into an unsaturated state, since saturated steam is often difficult to handle on account of condensation. The steam is brought into an unsaturated state by heating it further. To this end, the steam is passed out of the compartment to the outside and led to a separate superheater. In the superheated the steam is heated by the provision of heat.

This process has the disadvantage that extra energy is required for heating the steam in the superheater. Moreover, the installation is relatively voluminous in view of the fact that the superheater is located outside the actual heat exchanger and connected to it by means of pipes.

It is an object of the present invention to overcome the above disadvantages.

The present invention therefore provides a process for heating steam formed from cooling water in a heat exchanger for hot gas, characterized in that the steam is heated by the gas to be cooled.

The invention also provides an apparatus for carrying out the above process comprising a vessel with an inlet for the gas to be cooled, a compartment for cooling water with a pipe or tube system for transmitting the gas to be cooled and a collecting space for generated steam, characterized by one or more superheater modules or guiding means connected to the tube system with an outlet for the discharge of the cooled gas and a steam tube connected to the collecting space and passing through the superheater module(s) or guiding means.

In this way, according to the invention, the heat in the process gas is used to obtain superheated steam without the use of separate superheaters located outside the cooling installation.

Advantageously, the steam is heated by gas that has already cooled off somewhat. Direct heating of the steam by the still uncooled gases would, in view of the high temperature of the gas (1300° C.), give rise to material problems.

More advantageously, the cooled gas is led through a space for heating the steam in which the pressure is determined by the steam to be heated. In the known processes employed up to now, in which the steam was heated outside the cooling installation, costly measures were necessary to cope with the high gas pressures. In order to prevent the ash and soot particles present in the process gas being deposited in the installation, the velocity of the gas being cooled is kept above a certain minimum. This considerably reduces the chance of dirt particles settling out.

Figure 1B:
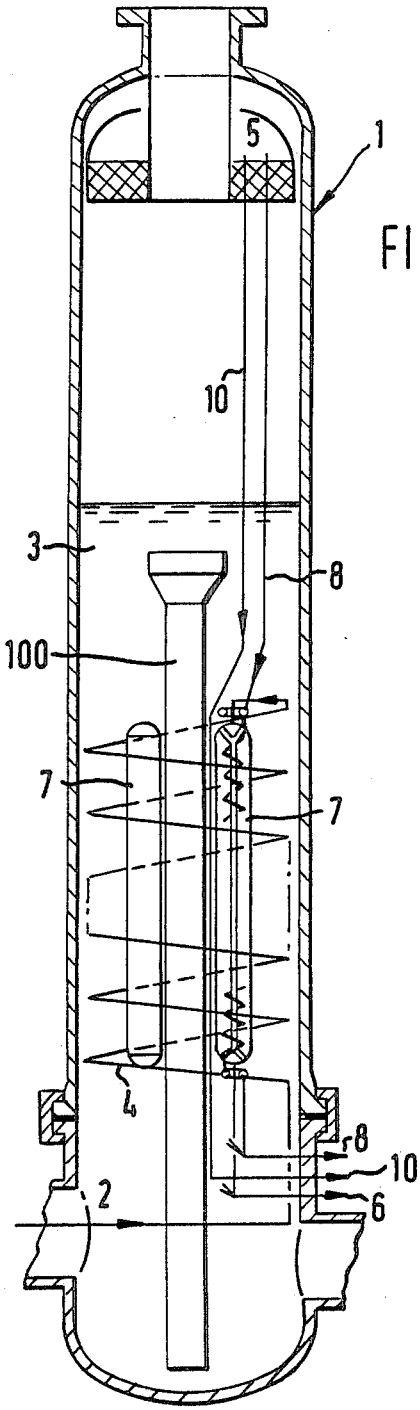
Figure 2:
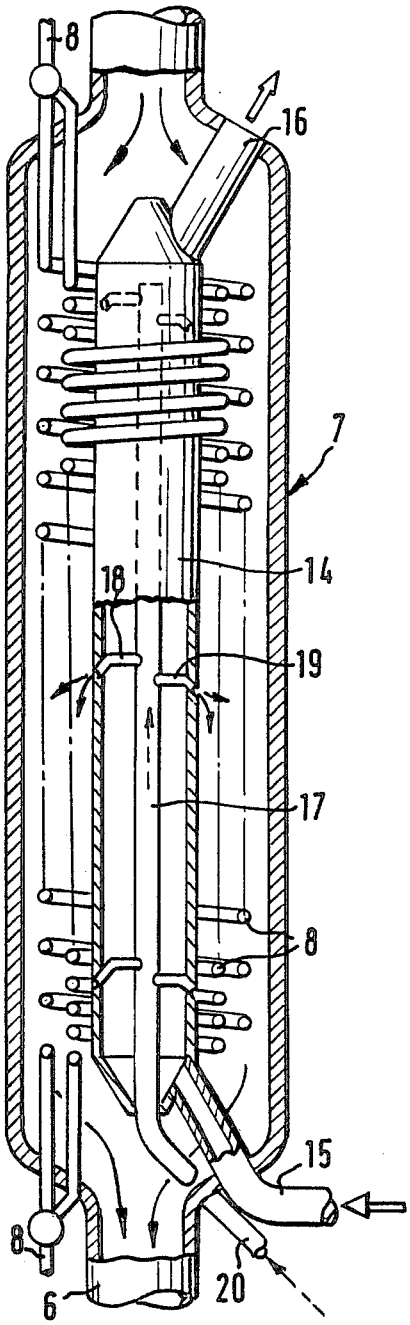
Figure 3:
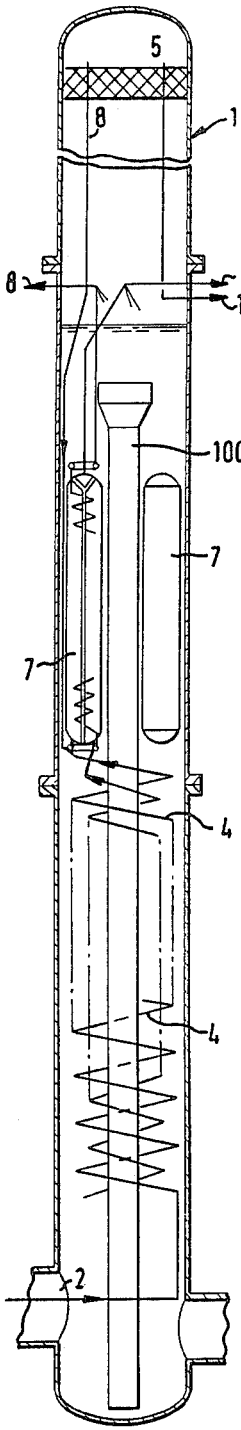

The invention will now be described by way of example in more detail with reference to the accompanying drawings, in which:

FIG. 1*a* shows schematically a longitudinal section of the apparatus according to the invention;

FIG. 1*b* shows a longitudinal section of an advantageous embodiment of the inventor;

FIG. 2 shows on a larger scale a part of the apparatus according to FIG. 1*a;* and FIG. 3 shows a longitudinal section of another advantageous embodiment of the invention.

Referring now to FIG. 1*a* the apparatus of the invention comprises a vessel 1, provided with a supply connection 2 for the gas to be cooled, a compartment 3 for cooling water, a tube system 4, which serves as a heat exchanger, for transmitting the gas to be cooled, and a collecting space 5 for collecting steam formed from the cooling water. The tube system 4 may for example consist of a spiral tube.

To the tube system 4 serving as a heat exchanger is connected at least one superheater module or guiding means 7, which is provided with an outlet 6 for the cooled gas, as well as a steam tube 8, which can, for example, be in the form of a spiral, the steam tube 8 being connected to the collecting space 5 and passing through the superheater module or guiding means 7. For reasons of clarity only one superheater module or guiding means 7 has been represented. The tube system 4 serving as a heat exchanger is connected to the superheater module or guiding means 7 near the steam tube 8 in any way suitable for the purpose. The cross section of the guiding means 7 is advantageously considerably larger than that of the tube system 4. With the aid of a valve 9, the steam leaving the steam tube 8 can be mixed with the saturated steam from the collecting space 5 which is fed through the bypass-pipe 10. This makes it possible to maintain the temperature of the superheated steam from the pipe 11 as constant as possible, while also controlling the gas temperature from the pipe 6 in a limited manner. To this end, the valve 9 is connected via a control pipe 12 to a temperature sensor 13.

Referring now to FIG. 1*b* an advantageous embodiment of the invention is represented. The same reference numerals as in FIG. 1*a* have been used. An arrangement of two superheater modules 7 and a central down comer 100 are shown. For reasons of clarity only one superheater module 7 is shown as being connected to the respective inlets and outlets for steam and gas, but it should be clear that the other superheater module(s) 7 is (are) also provided with respective inlets and outlets for steam and gas.

In this embodiment the steam by-pass 10 is arranged inside the vessel 1 and the valve 9 has not been represented.

FIG. 2 shows the superheater module or guiding means 7, of FIG. 1*a* on a larger scale. As can be seen from FIG. 2, the steam tube 8 can consist of a double spiral tube. It will be appreciated that any suitable number of such tubes can be applied. The gas flows into the superheater module or guiding means 7 at the top and has by then already been cooled somewhat. In this embodiment, the steam to be heated flows through the steam tube co-currently with the gas, although it is also possible for the two media to flow in counter-current. It will be appreciated that hybrid lay-out options can be applied. The term hybrid lay-out option means that, e.g. a superheater module may comprise a first co-current portion in which the gas is introduced and a second counter-current portion. A pipe 14 is fitted in the guiding means 7. On the one hand, the pipe 14 serves the function of a supply pipe for cooling water or a water/-steam mixture, for which purpose the pipe 14 is provided with a water supply connection 15 and a cooling water/steam discharge connection 16. On the other hand, the pipe 14 serves to reduce the cross section of the guiding means 7 in order to keep the flow velocity of the gas above a minimum value so as to make the change of ash and soot particles being deposited in the guiding means 7 as small as possible. A pipe 17 is fitted within the pipe 14 and connected via passages, e.g. 18, 19, to openings in the pipe 14. The pipe 17 is provided with a fluid supply line 20. This arrangement enables a suitable fluid, such as steam or compressed gas or synthesis gas, to be blown into the superheater module or guiding means 7 via the connection 20, the pipe 17 and the passages 18 and 19 and thereby remove any deposit of ash or soot.

Referring now to FIG. 3 another advantageous embodiment of the invention has been represented. The same reference numerals as in FIGS. 1–2 have been used.

In FIG. 3 each superheater module 7 is connected to at least two pipes or tubes for transmitting the gas to be cooled. For reasons of clarity only one superheater module 7 has been shown as being connected in such a manner, but it should be clear that the other superheater module(s) 7 is (are) also connected in such a manner.

In the embodiment of FIG. 3 lowering of the water level to e.g. ultimately ⅓ of the height of a (co-current) superheater module is now feasible, which then not only controls the superheated steam quality but also the gas temperature level ex vessel 1.

It will be appreciated that more slender design of the vessel results in easier accessability/maintainability of the superheater modules and a large upscaleability potential.

Further, if gas control ex vessel via variable water level would not work satisfactory, complete submerging of the superheater modules would be an easy fallback.

The installation operates as follows. The gas to be cooled is passed via the connection 2, the tube system 4 and the superheater module or guiding means 7 through the vessel 1 and discharged via the outlet 6 to the outside. During this process, the gas is successively cooled by the cooling water, while cooling off further in the guiding means 7, but in doing so also heating up the steam formed from the cooling water and caught in the collecting space 5 and fed through the steam tube 8. The heated steam reaches such a temperature that it is passed to the outside via steam tube 8 in an unsaturated state.

It will be appreciated that any number of superheated modules or guiding means suitable for the purpose can be arranged in a vessel.

It will further be appreciated that any suitable number of gas transmitting tubes may enter a superheater module. In case of two or more gas tubes entering one superheater module, the central down-comer tube should be extended with the gastubes entering the superheater module circumferentially at a certain pitch.

Various modifications of the present invention will become apparent to those skilled in the art from the foregoing description and accompanying drawing. Such modifications are intended to fall within the scope of the appended claims.

I claim:

1. An apparatus for heating steam formed from cooling water in a heat exchanger for hot gas, comprising:

a vessel having a compartment for cooling water, an inlet for the gas to be cooled, and a collecting space for maintaining generated steam;

at least one gas transmitting tube for transmitting gas from the inlet into the water cooling compartment;

at least one steam tube connected to the collecting space; and at least one superheater module situated within the cooling water compartment of said vessel, each module having an inlet end and an outlet end with the outlet end defining an outlet, each module being connected to at least one gas transmitting tube at its inlet end for the passage through the module of gas to its outlet end and out its outlet, and to a respective steam tube, said steam tube passing through the superheater module from its inlet end to its outlet end.

2. The apparatus as defined in claim 1, wherein each gas transmitting tube and each steam tube connected at the inlet end of a superheater module are connected near each other.

3. The apparatus as defined in claim 1, wherein the cross-section of each superheater module is larger than the cross section of its associated gas transmitting tubes.

4. The apparatus as defined in claim 1, wherein the cross section of each steam tube is smaller than the cross section of its associated superheater module.

5. The apparatus as defined in claim 1, wherein each superheater module includes a cross-section-reducing pipe fitted therein.

6. The apparatus as defined in claim 5, wherein the cross-section-reducing pipe includes a supply line and a discharge line for the passage of a water/steam mixture.

7. The apparatus as defined in claim 6, wherein a further pipe is located within the cross-section-reducing pipe with passage means for connecting the further pipe to the cross-section-reducing pipe, said further pipe serving to pass water/steam through said passage means to the gas to be cooled in the superheater module.

8. The apparatus as defined in claim 1, wherein each superheater module has one gas transmitting tube connecting thereto.

9. The apparatus as defined in claim 1, wherein each superheater module has two gas transmitting tubes connected thereto.

* * * * *

UNITED STATES PATENT AND TRADEMARK OFFICE

CERTIFICATE OF CORRECTION

PATENT NO. : 4,796,570

DATED : January 10, 1989

INVENTOR(S) : Herman J. Lameris

It is certified that error appears in the above-identified patent and that said Letters Patent is hereby corrected as shown below:

On the title page, item (22) "Sep. 30, 1987" should read -- July 30, 1987 --.

Signed and Sealed this

Twenty-sixth Day of September, 1989

*Attest:*

DONALD J. QUIGG

*Attesting Officer*

*Commissioner of Patents and Trademarks*